US007914009B1

(12) United States Patent
Gerspach

(10) Patent No.: US 7,914,009 B1
(45) Date of Patent: Mar. 29, 2011

(54) UNIVERSAL POOL SKIMMER GASKET

(76) Inventor: Paul Gerspach, Grand Island, NY (US)

( * ) Notice: Subject to any disclaimer, the term of this patent is extended or adjusted under 35 U.S.C. 154(b) by 398 days.

(21) Appl. No.: 12/151,098

(22) Filed: May 2, 2008

(51) Int. Cl.
*H02G 3/22* (2006.01)
*F16J 15/02* (2006.01)

(52) U.S. Cl. ..... 277/609; 277/637

(58) Field of Classification Search ..... 277/606, 277/609, 630, 637, 650
See application file for complete search history.

(56) References Cited

U.S. PATENT DOCUMENTS

| | | | | |
|---|---|---|---|---|
| 1,986,465 | A * | 1/1935 | Dempsey | 277/632 |
| 3,175,832 | A * | 3/1965 | Carrell | 277/632 |
| 3,231,289 | A * | 1/1966 | Carrell | 277/632 |
| 3,379,814 | A | 4/1968 | Bracey | |
| 4,380,564 | A | 4/1983 | Cancio | |
| 5,285,538 | A | 2/1994 | Hodak | |
| D365,381 | S | 12/1995 | Hoeppner | |
| 5,797,975 | A | 8/1998 | Davis | |
| 6,386,550 | B1 * | 5/2002 | Mokrzycki et al. | 277/616 |
| 7,011,747 | B2 | 3/2006 | Hodak | |
| 7,052,602 | B2 | 5/2006 | Boggs | |
| 7,195,708 | B2 | 3/2007 | Mullner, Jr. | |
| 2006/0124521 | A1 | 6/2006 | Hodak | |

FOREIGN PATENT DOCUMENTS

JP 61149213 A * 7/1986

* cited by examiner

*Primary Examiner* — Vishal Patel
(74) *Attorney, Agent, or Firm* — Vincent G. LoTempio; Douglas R. Smith; Kloss, Steager & LoTempio

(57) ABSTRACT

The present invention is universal gasket for a pool skimmer opening, which comprises an essentially rectangular planar sheet of material with a horizontal top member and a horizontal bottom member; a first and second vertical member connected to the horizontal top member and the horizontal bottom member defining a rectangular first end opening; a third vertical member connected to the horizontal top member and the horizontal bottom member defining a middle opening in conjunction with the second vertical member; a fourth vertical member connected to the horizontal top member and the horizontal bottom member defining second end opening in conjunction with the third vertical member; and wherein the vertical and horizontal members are individually, selectively detachable from the planar sheet to alter the shape of the planar sheet and cause the remaining portion of the planar sheet to form a standard sized gasket for a pool skimmer opening.

5 Claims, 2 Drawing Sheets

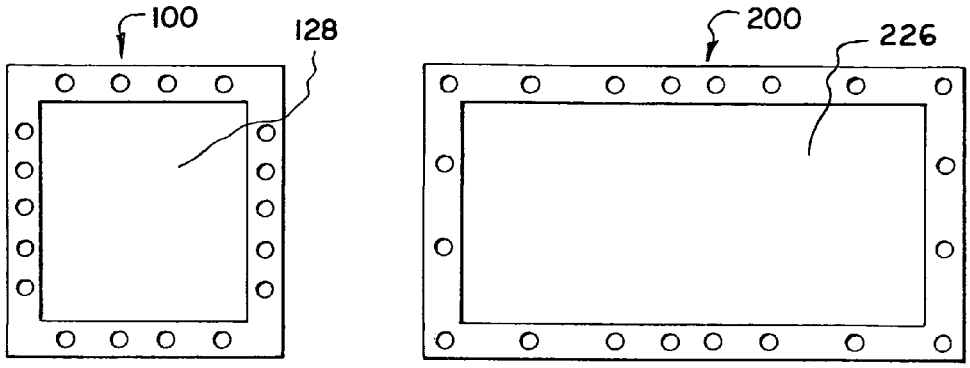
FIG. 1
PRIOR ART
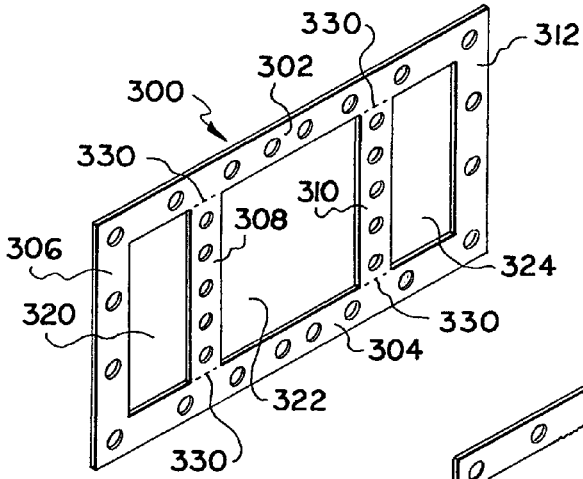
FIG. 2A
FIG. 2B
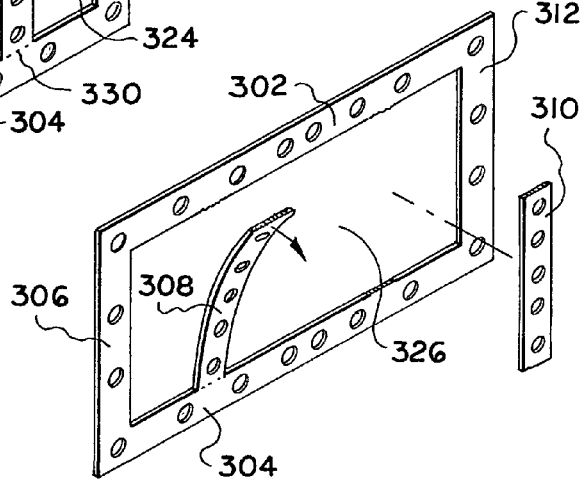

FIG. 3A
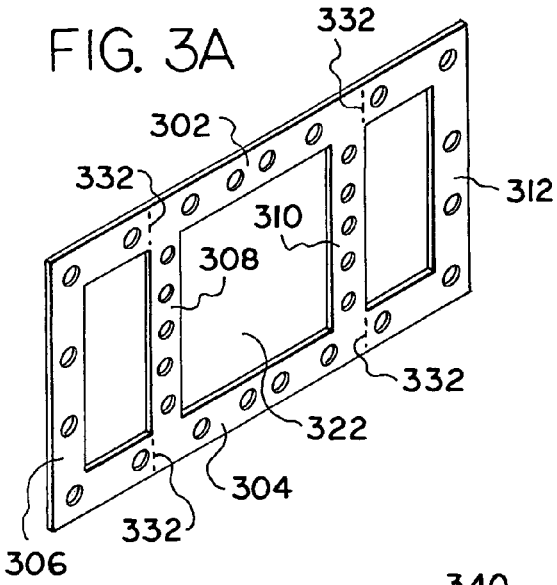
FIG. 3B
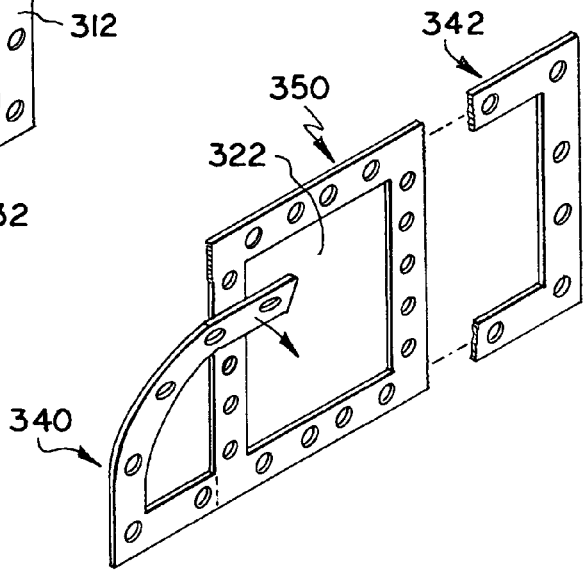
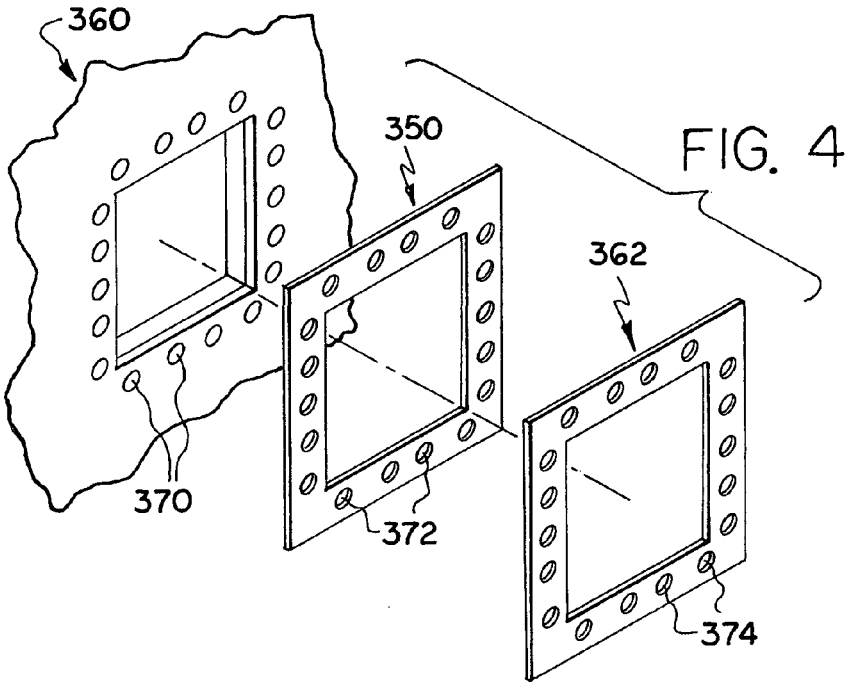
FIG. 4

UNIVERSAL POOL SKIMMER GASKET

BACKGROUND OF THE INVENTION

1. Field of the Invention

This invention relates to a universal pool skimmer gasket. More particularly, the invention relates to a gasket containing extraneous portions which can be selectively removed in order to modify the gasket to accommodate openings of different shapes and sizes.

2. Background

Pool skimmers contain gaskets which need to be replaced periodically. However, gasket replacement can become unnecessarily complicated because there are several types of pool skimmers which require specific gaskets. For example, some pool skimmers have square openings, and accordingly require square-shaped gaskets conforming to the square openings. Also common, however, are pool skimmers having rectangular openings which require rectangular gaskets. Accordingly, it is often a hassle for customers to buy a gasket, as they may not know which particular gasket fits their skimmer. Also, stores, warehouses, and other businesses are burdened by having to stock many types of gaskets.

Previous inventions have addressed the inconvenience of having various similar but incompatible products. U.S. Pat. No. 5,797,975 issued to Davis, discloses a filter frame which can be "broken down" in order to accommodate filter mats of various sizes. The invention comprises a grid like frame structure where one or more sections of the frame can be broken off of the structure. The filter frame can be adapted to accommodate any standard filter mat sizes by breaking off the appropriate sections of the grid structure. However, this system is limited in application to filter frames, and does not address the need for universal pool skimmer components.

U.S. Pat. No. 4,380,564 issued to Cancio discloses a decorative material which can be modified to conform to surfaces of various shapes. Specifically, this invention teaches a method of producing a decorative plastic sheet material which can be torn by hand to an appropriate size to conform to a surface being covered. However, this method is limited to producing decorative materials, and does not address the need for universal pool skimmer components.

Thus it is readily apparent that there is a long felt need for a universal gasket which can replace multiple conventional gaskets.

SUMMARY OF THE INVENTION

The present invention features a universal gasket which can be adapted to fit more than one opening. The present invention is in the shape of a conventional gasket, but also contains additional members and/or openings. By removing one appropriate set of members, the remaining structure of the gasket will conform to the opening of one variety of pool skimmers. The removed members may be discarded. Likewise, by removing a different set of members, the gasket can be adapted for use in a different variety of pool skimmers. In this way, the present invention can be used in place of at least two types of ordinary gaskets. In one embodiment of the present invention, the extraneous members may be removed simply by cutting them off with scissors.

It is accordingly a primary object of the present invention to provide a universal gasket which can accommodate more than one type of opening.

Another object of the invention is to provide a universal gasket which can be modified to fit a desired opening without the use of specialized tools.

Yet another object of the invention is to minimize the number of types of gaskets that a store must keep in stock.

A further object of the invention is to allow a person to buy a useable gasket without knowing the dimensions or model number device for which it is to be used.

Additional objects and advantages will become apparent and a more thorough and comprehensive understanding may be had from the following description and claims taken in conjunction with the accompanying drawings forming a part of this specification.

BRIEF DESCRIPTION OF THE DRAWINGS

The present invention and the manner in which it may be practiced is further illustrated with reference to the accompanying drawings wherein:

FIG. 1 is an elevated view showing a prior art gasket for use with a standard skimmer, and a prior art gasket for use with a wide mouth pool skimmers.

FIG. 2(*a*) is a perspective view of an embodiment of the present invention showing the regions that must be cut with scissors in order to configure it for use with a wide mouth pool skimmer having a rectangular opening.

FIG. 2(*b*) is a perspective view of an embodiment of the present invention in the process of being configured for use with a wide mouth pool skimmer having a rectangular opening.

FIG. 3(*a*) is a perspective view of an embodiment of the present invention showing the regions that must be cut with scissors in order to configure it for use with a standard pool skimmer having a square opening.

FIG. 3(*b*) is a cut away view of an embodiment of the present invention in the process of being configured for use with a standard pool skimmer having a square opening.

FIG. 4 is a side elevation view of an embodiment being installed in a standard pool skimmer after it has been configured for use in a square opening.

DETAILED DESCRIPTION OF THE INVENTION

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Adverting now to the drawings, with reference to FIG. 1, two prior art pool skimmer gaskets are shown. Numeral 100 depicts a prior art gasket for use with a standard pool skimmer with a square opening. Standard skimmer square opening 128 is shaped and sized to conform to the opening of a standard skimmer. Numeral 200 depicts a prior art gasket for a wide mouth pool skimmer having a rectangular opening. Wide mouth skimmer rectangular opening 226 is shaped and sized to conform to the opening of a wide mouth skimmer.

FIG. 2(*a*) shows the preferred embodiment of the present invention prior to adapting it to fit the rectangular opening of a wide mouth pool skimmer. The preferred embodiment of the universal pool skimmer gasket 300 comprises an essentially rectangular planar sheet of material with a horizontal top member 302 and a horizontal bottom member 304, a first and second vertical member, 306 and 308 respectively, connected to the horizontal top member 302 and the horizontal bottom member 304 defining a rectangular first end opening 320. A third vertical member 310 is connected to the horizontal top member 302 and the horizontal bottom member 304 defining a middle opening 322 in conjunction with the second vertical member 308. A fourth vertical member 312 is connected to the horizontal top member 302 and said horizontal bottom member 304 defining second end opening 324 in conjunction with the third vertical member 310. The aforementioned vertical and horizontal members are individually, selectively detachable from the planar sheet of which preferred embodiment of the universal pool skimmer gasket 300 is comprised of to alter the shape of the planar sheet and cause the remaining portion of the planar sheet to form a standard sized gasket for a pool skimmer opening.

To fit a rectangular opening, the outer perimeter of the gasket, comprised of members 302, 304, 306, and 312 is left intact. Two extraneous vertical members 308 and 310 are removed. In our preferred embodiment, the extraneous members 308 and 310 may be removed by cutting them off with an ordinary pair of scissors along the wide mouth skimmer configuration cutting lines 330. It should be noted that the wide mouth configuration cutting lines 330 are not present on some embodiments. While in other embodiments these lines may be printed on the surface of the gasket, or alternatively, they may be in the form of perforations. Additionally, it should be understood that other embodiments may be adapted to fit a desired opening in other ways, such as by tearing off by hand extraneous portions or otherwise.

FIG. 2(*b*) shows the preferred embodiment in the process of being configured for use with a wide mouth pool skimmer having a rectangular opening. The third vertical member 310, has been removed and may be discarded. The second vertical member 308 is in the process of being removed, and may be discarded once removed. Once vertical member 308 is completely removed, the remaining portion of the universal pool skimmer gasket is now rectangular in shape, and will have a single large rectangular opening 326 which is identical in shape and size to the wide mouth skimmer rectangular opening 226 of a prior art gasket for a wide mouth pool skimmer 200 of FIG. 1. Without the extraneous members, the universal pool skimmer gasket is identical in size and shape to the prior art gasket for a wide mouth pool skimmer 200 of FIG. 1. As such, it is now ready to be installed in a wide mouth skimmer.

FIG. 3(*a*) shows the preferred embodiment of the present invention prior to adapting it to fit the square opening of a standard pool skimmer. To fit a square opening, the second vertical member 308 and third vertical member 310 surrounding middle opening 322 are left intact, while cuts are made along the standard skimmer configuration cutting lines 332. Making these cuts removes two substantially 'C' shaped regions. The first substantially 'C' shaped region, 340 of FIG. 3(*b*) consists of the first vertical member 306, a portion of the left end of horizontal top member 302, and a portion of the left end of horizontal bottom member 304. The second substantially 'C' shaped region, 342 of FIG. 3(*b*) consists of the fourth vertical member 312, a portion of the right end of horizontal top member 302, and a portion of the right end of horizontal bottom member 304. Again, both extraneous substantially 'C' shaped regions 340 and 342 of FIG. 3(*b*) may be removed by cutting them off with an ordinary pair of scissors. However, it should be understood that other embodiments may be adapted to fit a desired opening in other ways, such as by tearing off by hand extraneous portions or otherwise. It should be noted that the standard skimmer configuration cutting lines 332 are not present on some embodiments. While in other embodiments these lines may be printed on the surface of the gasket, or alternatively, they may be in the form of perforations.

FIG. 3(*b*) shows a universal pool skimmer gasket in the process of being configured for use with a standard pool skimmer having a square opening. The first substantially 'C' shaped region 340 has been partially removed, and may be discarded once it is completely removed. The second substantially 'C' shaped region 342 has been removed, and may be discarded. The remaining portion of the universal gasket after configuration for a standard pool skimmer 350 is square in shape, and has a single square middle opening 322 which is identical in shape and size to the standard skimmer square opening 128 of a prior art gasket for a standard pool skimmer 100 of FIG. 1. The universal pool skimmer gasket is now identical in size, shape, and configuration to the prior art gasket for a standard pool skimmer 100 of FIG. 1. As such, it is now ready to be installed in a standard skimmer.

FIG. 4 shows the preferred embodiment being installed in a pool skimmer after it has been configured for use with a standard pool skimmer having a square opening. Installation is identical to that of the prior art gasket for a standard pool skimmer 100 of FIG. 1. To install the universal pool skimmer gasket in one variety of standard pool skimmers, the remaining portion of the universal gasket after configuration for a standard pool skimmer 350 is placed between a wall panel 360 and a face plate 362. A plurality of holes to accept fasteners 370, 372, and 374 in the wall panel 360, the remaining portion of the universal gasket after configuration for a standard pool skimmer 350, and the face plate 362 respectively will align with each other allowing fasteners such as screws to pass through. It should be noted that the installation process may vary, and that the present invention is not limited to any one type of installation method. Rather, the present invention may be installed in any appropriate way.

Although the invention as been described with reference to certain preferred embodiments, it will be appreciated by those skilled in the art that modifications and variations may be made without departing from the spirit and scope of the invention. It should be understood that applicant does not intend to be limited to the particular details described above and illustrated in the accompanying drawings. In this regard, the term "means for" as used in the claims is intended to include not only the designs illustrated in the drawings of this application and the equivalent designs discussed in the text, but it is also intended to cover other equivalents now known to those skilled in the art, or those equivalents which may become known to those skilled in the art in the future.

The invention claimed is:

1. A universal gasket for a pool skimmer opening, which consist of:

an essentially rectangular planar sheet of material with a horizontal top member and a horizontal bottom member;

a first and second vertical member connected to said horizontal top member and said horizontal bottom member defining a rectangular first end opening;

a third vertical member connected to said horizontal top member and said horizontal bottom member defining a middle opening in conjunction with said second vertical member;

a fourth vertical member connected to said horizontal top member and said horizontal bottom member defining second end opening in conjunction with said third vertical member; and wherein said vertical and horizontal members are individually, selectively detachable from said planar sheet to alter the shape of the planar sheet and cause the remaining portion of the planar sheet to form a standard sized gasket for a pool skimmer opening;

a plurality of holes within each of said horizontal and vertical members wherein said holes are designed to coordinate with a pre-existing fastening means of a standard swimming pool filter assembly for fastening said gasket to said pool skimmer opening; and a perforation in the horizontal and vertical members to form a removable area which can be selectively removed to alter the shape of the planar sheet and cause the remaining portion of the planar sheet to form a standard sized gasket for a pool skimmer opening.

2. The universal gasket for a pool skimmer opening of claim 1 having lines printed on the surface of the horizontal and vertical members to demark regions which can be selectively removed to alter the shape of the planar sheet and cause the remaining portion of the planar sheet to form a standard sized gasket for a pool skimmer opening.

3. The universal gasket for a pool skimmer opening of claim 1 wherein the essentially rectangular planar sheet of material is composed of cork.

4. The universal gasket for a pool skimmer opening of claim 1 wherein the essentially rectangular planar sheet of material is composed of rubber.

5. The universal gasket for a pool skimmer opening of claim 1 wherein the essentially rectangular planar sheet of material is composed of at least one resin.

* * * * *